United States Patent [19]

Curran et al.

[11] 4,173,314

[45] Nov. 6, 1979

[54] CONTINUOUS WEB SUPPLY APPARATUS

[75] Inventors: Thomas F. Curran, Wauconda; Leonard I. Tafel, Palatine; Caspar F. Engert, Northlake; Robert E. LaBarre, Hanover Park, all of Ill.

[73] Assignee: Cary Metal Products, Inc., Barrington, Ill.

[21] Appl. No.: 896,697

[22] Filed: Apr. 17, 1978

[51] Int. Cl.[2] ..... B65H 19/16

[52] U.S. Cl. ..... 242/58.4; 156/502

[58] Field of Search ..... 242/58.1, 58.2, 58.3, 242/58.4, 58.5, 58.6, 75.1; 156/502, 504, 506

[56] References Cited

U.S. PATENT DOCUMENTS

| | | | |
|---|---|---|---|
| 1,085,907 | 2/1914 | Hoe | 242/75.1 |
| 1,409,659 | 3/1922 | Brewer | 242/58.1 |
| 1,464,463 | 8/1923 | Wood | 242/58.1 |
| 3,252,671 | 5/1966 | Phillips | 242/58.1 |
| 3,391,877 | 7/1968 | Angell | 242/58.3 |
| 3,861,612 | 1/1975 | Kubo | 242/58.3 |

*Primary Examiner*—Edward J. McCarthy
*Attorney, Agent, or Firm*—McDougall, Hersh & Scott

[57] ABSTRACT

An apparatus for providing a continuous supply of web material to a web printer or other system. The web material is fed from a first roll supported in a feed position, and when the first roll is near depletion, the leading end of a second roll is adhesively connected to the web of the first roll with that web then being severed. One belt drive means is employed for rotating both the forward and rearward rolls so that these achieve the same speed for the connecting and severing operations. The belt drive means are connected to the press drive through control means which vary the belt drive speed in accordance with the tension of the web. An indexing conveyor supports forward and rearward rolls to locate the rolls in the forward and rearward running positions and in intermediate positions for connecting and severing of the web material and for loading of new rolls into the system.

23 Claims, 13 Drawing Figures

CONTINUOUS WEB SUPPLY APPARATUS

BACKGROUND OF THE INVENTION

This invention relates to an apparatus for continuously supplying web material. In a typical use of the apparatus, the web material is fed to a web printing system which, for most efficient operation, requires an uninterrupted supply of web material to be printed. The references to web printing are provided for purposes of illustration since it will be understood that the apparatus of this invention will have application in other systems having similar requirements.

There are various systems available for providing continuous supplies of web material to a printing system or the like. These systems generally provide means for adhesively attaching a leading end portion of a new roll to the moving web of a roll which is near depletion. Such so-called "flying pasters" incorporate severing means for the roll which is near expiration, and mechanisms are then employed for moving the new roll into a running position. The old roll is removed from the apparatus, and a further roll brought into position so that the operation can be repeated.

One common flying pastor system involves two or three rolls mounted on a rotary spindle with rotation of the spindle bringing a new roll into position after a connecting and severing operation. Such systems have the disadvantage of requiring rather large amounts of space in both the horizontal and vertical directions, and they are only usable in circumstances where space is not a critical consideration.

Attempts have been made to provide efficient flying paster systems wherein rolls are moved horizontally. Such systems eliminate the need for vertical space, and Brewer U.S. Pat. No. 1,409,659 and Hoe U.S. Pat. No. 1,085,907 comprise examples of systems of this type. In these arrangements, the roll nearing depletion is moved in a horizontal direction, and a new roll moved into its place subsequent to the adhesive connecting and severing operation. A further roll then replaces the new roll so that the operation can be repeated.

Another system involves the use of rolls mounted on stationary axes. When one roll is near depletion, the flying plaster operation achieves connection with a new roll mounted on a different axis. The expired roll is then replaced by a further roll on another axis so that the operation can be repeated. Reference is made to Wood U.S. Pat. No. 1,464,463 and Phillips, et al. U.S. Pat. No. 3,252,671 for illustrations of structures of this type.

SUMMARY OF THE INVENTION

This invention provides a highly efficient means for avoiding problems encountered with prior systems. The invention is generally characterized by a highly compact structure so that a minimum amount of floor space is required. The invention is particularly adapted to the supply of a plurality of webs with the same floor space requirements as is the case when supplying a single web. Thus, the apparatus is uniquely suitable for stacking of one supply structure on the other so that only vertical space is required for increasing the number of webs supplied.

The apparatus of the invention is more particularly characterized by a fully automatic operation. One belt drive means is employed for driving both a forward and rearward roll so that the fresh roll will be moving at the same speed as the depleted roll when the new web is to be connected into the system and the old web is severed. It will be understood that references to "one" belt drive are intended to distinguish from the utilization of separate drive means for adjacent rolls. This invention may take the form of two or more spaced apart belts provided that the belts extend into engagement with the peripheries of forward and rearward rolls in the system with a common drive for the belts.

The automatic operation of the invention includes means for driving the belt means in response to changes in web tension. The belt drive is preferably connected to the drive means of the press with which the apparatus is associated. Tension detecting and control means are interpositioned between the respective drives so that the belt drive speed can be changed independently of the press drive.

The apparatus of the invention includes an endless conveyor roll indexing means which operates in conjunction with the belt drive. Thus, the respective rolls are moved into a series of positions by the conveyor whereby a smooth operation is achieved. More specifically, the conveyor includes spaced apart roll shaft supports adapted to be located in running positions whereat rolls are located at forward and rearward positions. When the forward roll is near depletion, the system indexes to an adhesive connecting and severing position. Thereafter, the conveyor movement brings a new roll shaft support into position for loading. The sequence is then repeated to locate the rolls in a running position, connecting and severing position, and loading position.

In the meantime, the depleted rolls are automatically indexed for discharging from the conveyor. By providing means for rotating these depleted rolls independently of the belt drive, free lengths of the depleted rolls are automatically rolled back onto the depleted rolls so that these free lengths are safely brought out of the system.

BRIEF DESCRIPTION OF THE DRAWINGS

FIG. 5 is an enlarged fragmentary sectional view illustrating the depleted roll take-up system utilized in the apparatus;

DETAILED DESCRIPTION OF THE DRAWINGS

Figure 1:
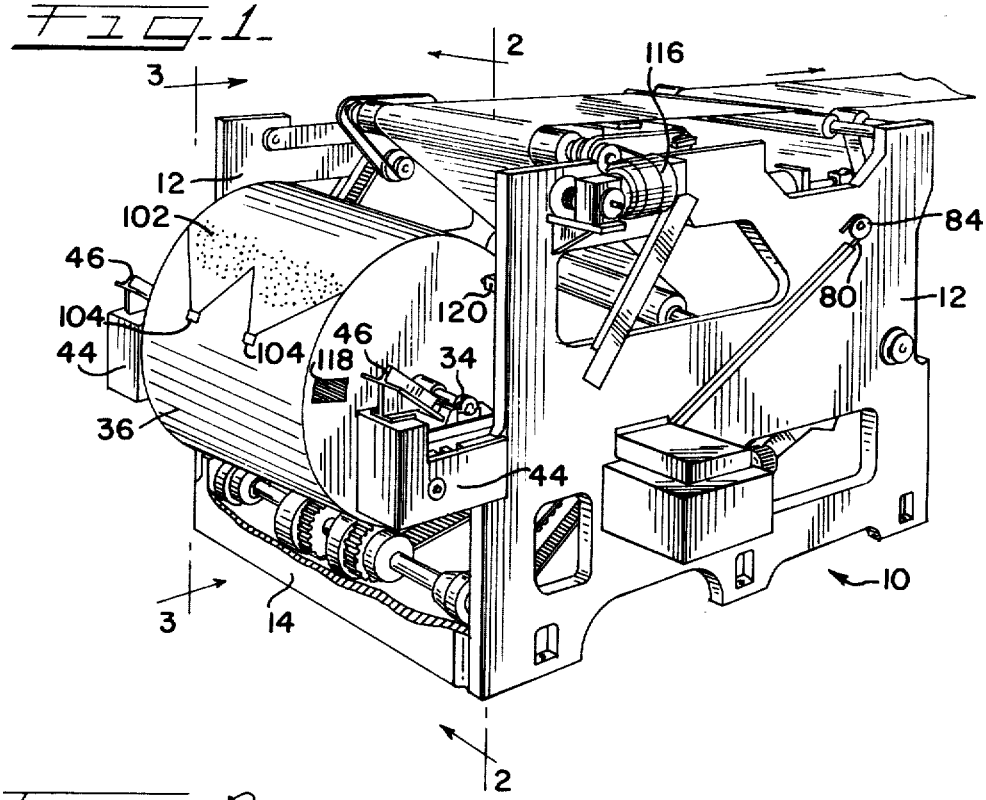
FIG. 1 is a perspective view of a web handling apparatus of the type contemplated by this invention.

The drawings illustrate an apparatus 10 consisting of side frames 12 supported by transverse frame member 14 and transverse beam 16. Spaced-apart upper and lower rails 18 and 20 are secured to each of the side frames. The side frames also provide means for supporting other elements in the system including guide rollers 24, 25 and 26 which are utilized for guiding the web 28 toward an offset printing press or the like.

The rails 18 and 20 comprise guide rails for conveyor chains 30 on each side of the apparatus. These conveyor chains include a plurality of spaced-apart roll shaft supports 32, these supports defining seats for receiving the ends 34 of the shafts which support rolls 36 of web material. Upper rails 18 serve as confining means for the shaft ends 34 preventing any possibility of a shaft end lifting out of a support 32.

The chain 30 on one side extends around idler sprockets 38. On the opposite side, one of the sprockets comprises a driven sprocket 40, and motor 42 is connected to this driven sprocket. A shaft 41 connects forward sprockets 38 so that the chains 30 move in unison.

The rearwardmost sprockets including driven sprocket 40 are enclosed in housings 44 supported on the side frames. A pair of ramps 46 are positioned on the housings for engagement by the roll shafts when a new roll 36 is loaded into the apparatus. Thus, a new roll is loaded when roll shaft supports 32 are positioned at the end of the ramps, and these ramps assist in properly seating the roll shaft ends 34 relative to the supports 32.

A drive means for the rolls 36 includes a pair of belts 48 positioned for engaging lower peripheral portions of the rolls. Positive drive pulleys 50 defining belt-engaging teeth are supported on shafts 52, 54 and 56 for holding the belts in firm driving relationship. Corresponding teeth are preferably defined by the belts 48 to achieve the desired control of the belt movement.

Figure 5:
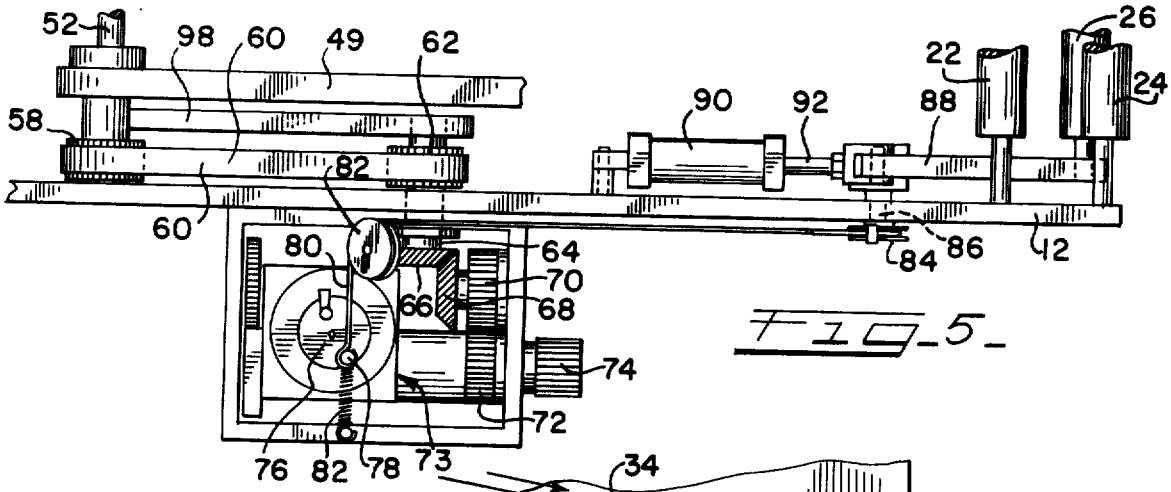
FIG. 5 is an enlarged fragmentary view illustrating the drive control mechanism utilized in the apparatus.

The shafts 54 and 56 are idler shafts while the shaft 52 is a driven shaft. This driven shaft extends to an additional driving pulley 58 which is engaged with drive belt 60 with the pulley and belt preferably defining corresponding teeth. The belt 60 also extends around pulley 62 which is supported on shaft 64. As best illustrated in FIG. 5, the shaft 64 supports helical gear 66 which is in driving engagement with gear 68. The gear 68 is mounted on the same shaft as gear 70 with the latter in driving engagement with gear 72. The gear 72 is connected through control 73 to gear 74. Drive means for the gear 74 will preferably comprise a direct connection with the press drive. On the other hand, the invention contemplates an independent drive means.

The gear 72 is associated with control 73 which comprises a Harmonic Servomission arrangement of the type manufactured by Cary Company, Inc. of Barrington, Ill. The details of this structure do not form a part of this invention, and it will be sufficient to note that the structure includes a control plate 76 which is rotatable about its axis by wire 80 which is connected to pin 78 mounted on the plate. This wire, when moved in opposition to the force of spring 82 serves, through the control mechanism, to vary the speed imparted to the drive belt 60.

The control wire 80 for the control 73 extends around sheaves 82 and 84, and the end of the wire is fixed to the latter. The sheave 84 is fixed to shaft 86 along with opposed triangular frames 88 whereby rotation of the frames results in rotation of the sheave 84 and corresponding movement in the wire 80.

The opposed frames 88 support dancer roller 26. A compression cylinder 90 includes piston rod 92 which is attached to one corner of a frame 88, and the cylinder is adjustable to provide a predetermined resistance to movement of the rod 92. This provides an adjustable tension set point, and tension increases or decreases in web 28 will tend to pivot the frame 88 to thereby cause control wire 80 to affect the control mechanism 73 thereby changing the speed of drive belt 60. This, in turn, will change the speed of the roll drive belts 48, adjusting the tension and allowing dancer roll 26 to return to the null point. By correlating these actions in a known fashion, the change in belt speed 48 will, in turn, adjust the tension in the web 28 to thereby automatically offset the conditions which caused the control function. Such conditions include surges caused by out-of-round or otherwise imperfect rolls, variations in "wound-in" paper tension, or printing press conditions. In any event, it will be appreciated that the described arrangement provides a means for maintaining tension in the web material at a substantially constant level.

Figure 2:
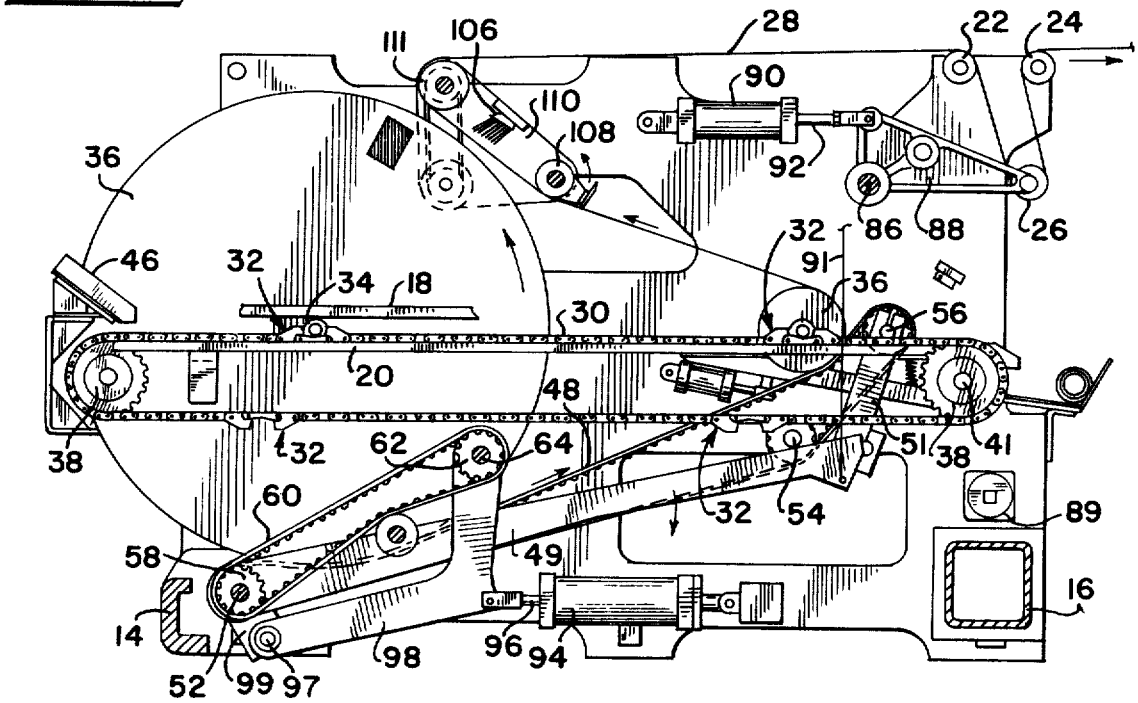
FIG. 2 is a vertical sectional view taken about the line 2—2 of FIG. 1.

The shafts 52, 54 and 56 supporting belts 48 are journalled in supporting arms consisting of rearward sections 49 and forward sections 51. On one side, as shown in FIG. 2, a compression cylinder 94 has a piston rod 96 connected to lever arm 98. This arm is attached at 97 to a downwardly extending portion 99 of arm section 49 of the apparatus with the other end of the lever arm supporting sprocket 62 and being pivoted about shaft 64.

A corresponding cylinder 94 is mounted on the opposite side frame 12, and the piston rod is attached to member 101 which is in turn attached at 103 to arm section 49. The combination of arm sections 49 and 51 and shafts 52, 54 and 56 essentially comprises a floating frame with the position of the frame being controlled by the cylinders 94, these cylinders preferably comprising pneumatic cylinders.

Figure 2A:
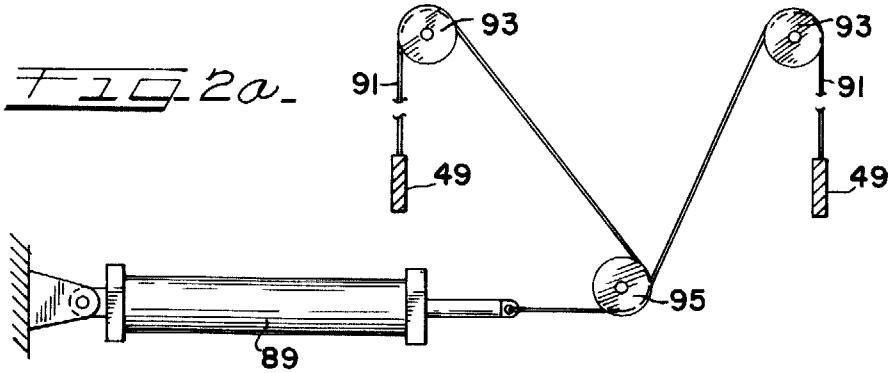
FIG. 2*a* is a fragmentary, perspective view illustrating a frame supporting means in the apparatus.
Figure 9:
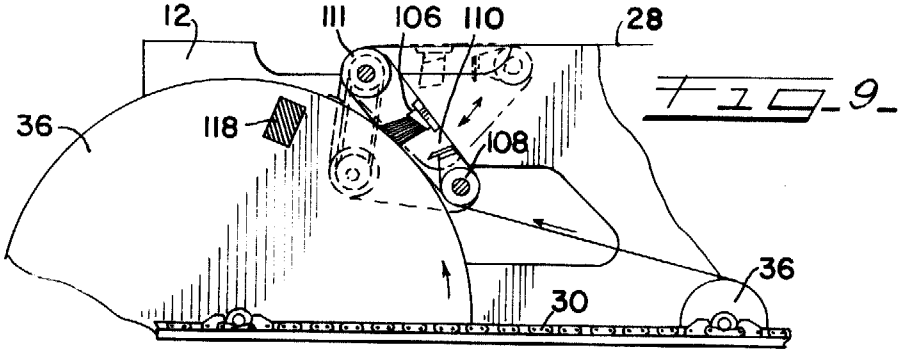
FIG. 9 is a schematic illustration of the flying paster structure utilized in the system.

As best shown in FIG. 2*a*, vertically extending cables 91 are connected to each of the arm sections 49, these cables extending over pulleys 93 and 95 and to cylinder 89. The arm sections 49 are pivotable about shaft 52 with the pivoting movement being limited by the setting of the cylinder 89. It will thus be appreciated that pivoting of the members 98 about shaft 64 in response to the operation of cylinders 94 will control the position of shaft 52. On the other hand, pivoting of arm sections 49 about shaft 52 in response to the action of cylinder 89 will control the position of shaft 56. Accordingly, both the front and rear positions of the drive belts 48 are controllable.

With this arrangement, the pressure of the drive belts 48 against the rolls 36 can be maintained even as the diameter of the rolls changes. Thus, by setting the cylinders at a given pressure, the floating frame will move in response to changes in roll diameter. The position of the frame is also controllable by increasing or decreasing pressure from the set point to pivot the frame independently of changes in roll diameter where this may be desired as when admitting a new roll and when advancing this roll to the paste position.

The belts 48 move in a path which extends beneath the peripheries of rolls 36 in both the forward and rearward positions. Thus, under certain conditions the belts 48 serve to rotate both rolls, and the peripheral speed of these rolls will thus be the same. In the condition of the apparatus shown in FIG. 2, the rolls are both being driven by the belts 48, and the forward roll 36 is near depletion. Under these circumstances, the apparatus is ready for connection of the new roll with the moving web, and for the subsequent severing of the web of the nearly depleted roll.

The mechanism for achieving this connection, the flying paster operation, includes the provision of adhesive on the leading end of the new roll as shown at 102 in FIG. 1. Strips of perforated tabs 104 hold this leading end against unwinding, the holding force being such that the leading end will be torn away when the adhesive connection is made.

The structure of the paster may be conventional in that it includes a brush 106 and blade supporting shaft 108. These mechanisms are mounted on triangular side frames 110 supporting upper web guide roller 111, and with each frame also supporting a pinion 112 engageable with rack surfaces 114 defined by housing 127. In response to an appropriate signal, drive motor 116 is operated for pivoting the triangular frames 110 about shaft 113 and into operation position.

Figure 10:
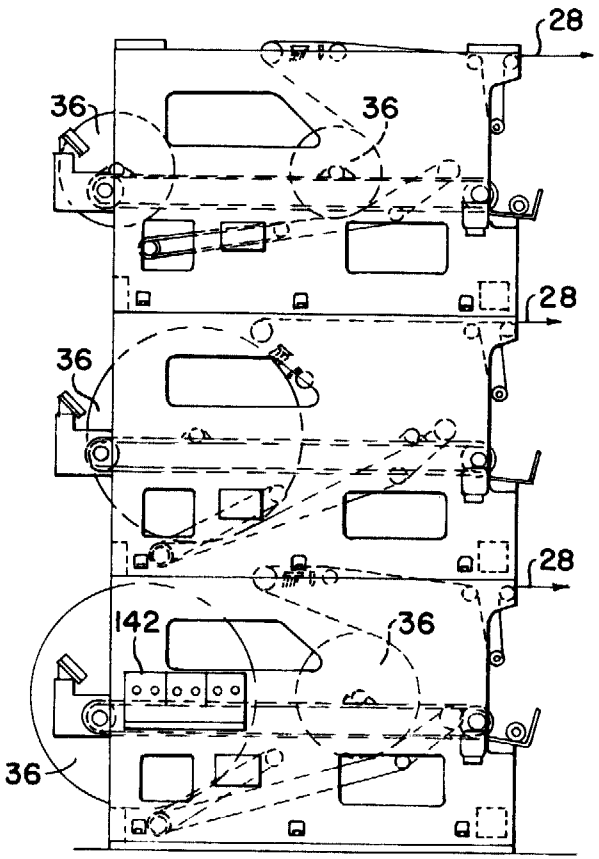
FIG. 10 is a schematic side view of a stack of structures of the type contemplated by the invention in various stages of operation.

This arrangement for mounting the frames 110 is advantageous since it will be noted that the upper edges of the frames are parallel with the top edges of side frames 12 when the frames are out of operating position. This simplifies stacking units as shown in FIG. 10. The drive means employed enables operation of the frames 110 within a minimum of space.

The shaft 113 also supports one end of drive belt 115, the other end of which extends to shaft 117. The gear 119 on this shaft is connected through chain drive 121 to motor 116. The motor 116 thus drives belts 123 which rotate pinions 112 relative to racks 114. The pinions are captive to the racks so that the position of side frames 110 is determined by the position of the pinions.

Figure 8:
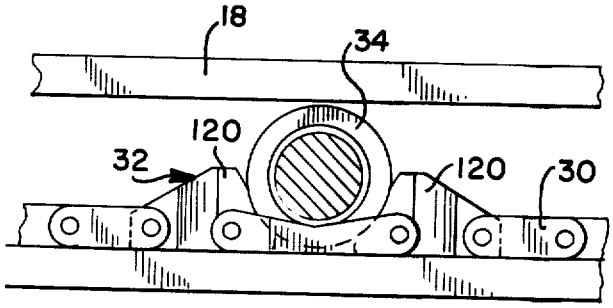
FIG. 8 is a fragmentary sectional view taken about the line 8—8 of FIG. 7.
Figure 7:
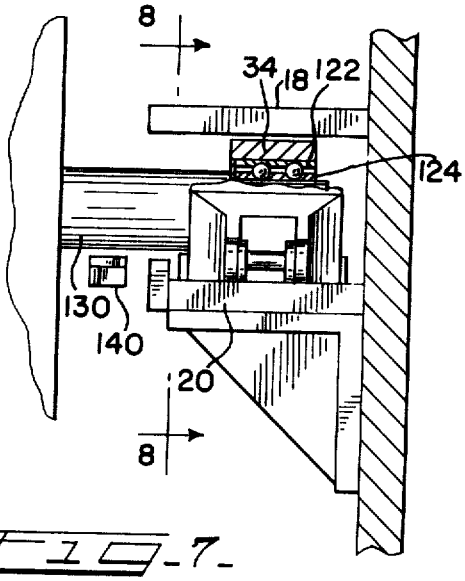
FIG. 7 is an enlarged fragmentary sectional view illustrating the roll shaft support and shaft structure utilized in the system.
Figure 7A:
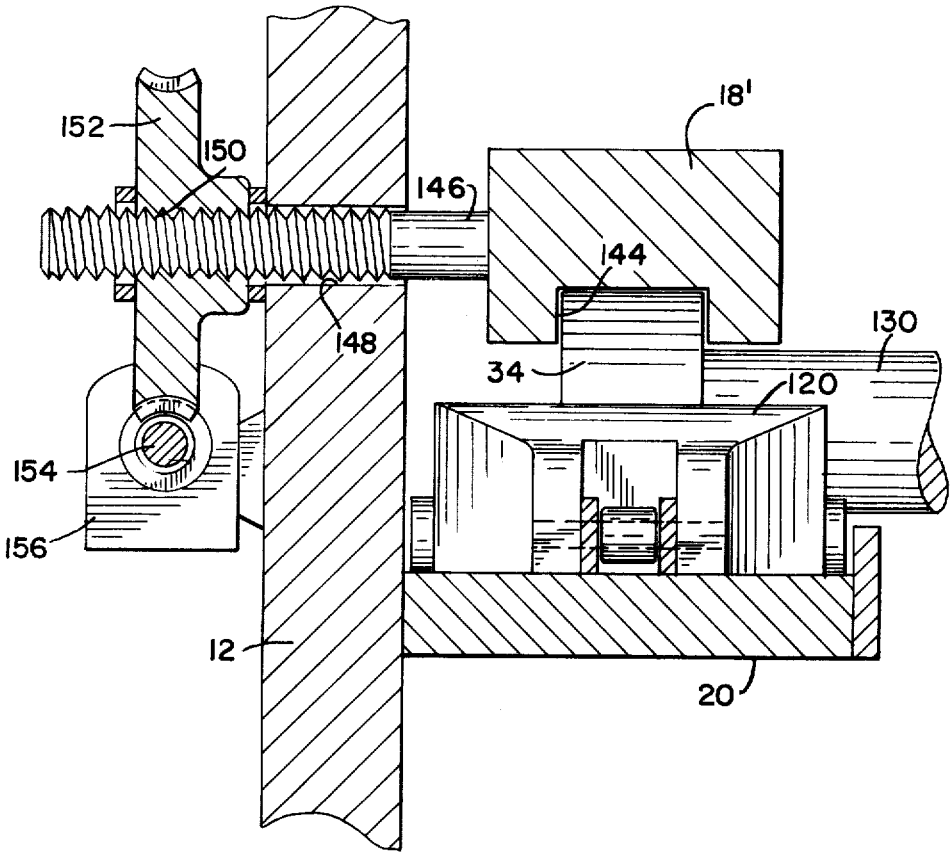
FIG. 7*a* is an enlarged fragmentary sectional view illustrating the roll shaft support and shaft structure utilized in the system and including an edge guide means.

FIGS. 7 and 8 illustrate in greater detail the roll shaft supports 32. These supports comprise opposed members 120 which define inwardly facing opposed surfaces dimensioned for receiving the ends 34 of the roll shafts. These ends 34, as best shown in FIG. 7, support bearing races 122 to provide a rotatable relationship with corresponding bearing races 124 formed at the ends of the roll shafts. It will be appreciated that with this arrangement, the roll shafts are freely rotatable relative to the roll shaft supports 32.

As will be described in greater detail, the sequence of operations include removal of the depleted, or nearly depleted, roll from the apparatus. In addition, this invention provides a means for rolling a free length of severed web material back on to the depleted roll so that this free length will not otherwise disrupt operation of the apparatus.

The mechanisms referred to comprises a plate 126 positioned at the end of the apparatus immediately adjacent a collecting trough 128 for the depleted rolls. This plate defines a corrugated or other high friction surface, and the plate is positioned inwardly of the rails 18 and 20 so that the plate will be engaged by an exposed shaft section 130. A plate 126 may be positioned on either side of the apparatus, and each plate is pivotally supported at 132 to a supporting lever 134. Compression spring 136 normally urges the plate upwardly for firm engagement with the roll shaft portion 130. A compression cylinder 138 operates to pivot the lever 134 upwardly to provide a further control of the pressure exerted by the friction plate 126 against the roll shaft portion. Where a pair of friction plates are provided, a transverse bar may be utilized for interconnecting the lever 134 so that a single cylinder 138 will provide the pressure for both plates 126. On the other hand, the mechanism shown in FIG. 6 may be located on both sides of the apparatus.

When the conveyor chain 30 is operated to drive a depleted roll toward the collecting trough 128, the roll will first be moved out of engagement with drive belts 48 as will be more completely discussed. When out of engagement with the belts 48, the friction plate 126 will cause reverse rotation of the depleted roll as the roll progresses toward the collecting trough. The length of the plate 126 will be sufficient to roll back the free length of web after the severing operation so that this free length will not be caught by other moving parts of the apparatus.

Figure 6:
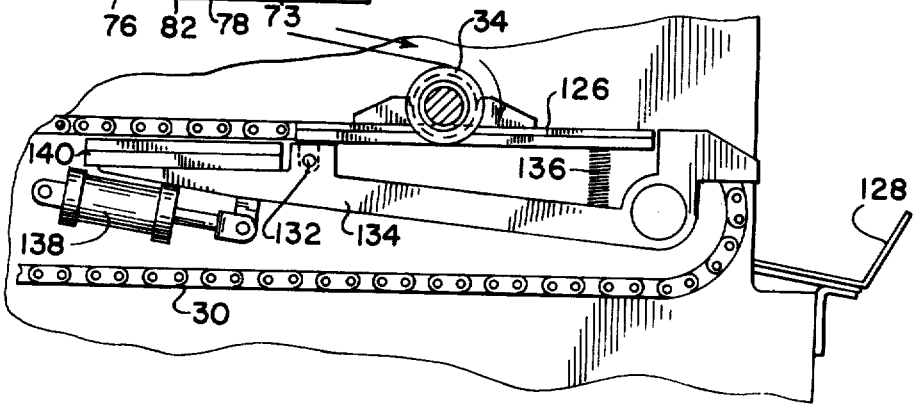

The structure of FIGS. 6 and 7 also includes a corebrake 140 adapted to engage exposed shaft section 130. Such corebrakes are known for use in conjunction with systems of the type described after severing of the web of the expiring roll. In accordance with this invention, however, the corebrake structure is operated prior to severing of the expiring roll. Thus, it has been observed that there is a tendency as the expiring roll becomes reduced in diameter for the expiring roll to become loose whereby the web material tends to telescope transversely relative to the roll shaft. The sequence of operations of this invention involves application of the corebrake 140 by means of cylinder 138 in response to the detection of a certain roll diameter. This application of the corebrake operates in conjunction with the belts 48 to maintain a tight relationship of the web material in the expiring roll. This relationship is maintained throughout the remainder of the roll rotation, that is, until a still smaller roll diameter is detected at which point the pasting and severing operation is initiated.

FIG. 10 illustrates the application of the invention to a system involving the use of three units stacked in vertical relationship. Thus, three independent webs 28 are adapted to be delivered by this assembly to separate web presses or other equipment. It will be noted that the operation of one unit is not necessarily dependent on the other so that the number of units in a stack is theoretically unlimited. On the other hand, it is contemplated that common drive mechanisms could be utilized for some portions of two or more of the units. A common control panel 142 may also be utilized for the respective units.

FIG. 10 also serves as a means for illustrating the sequence of operations in a typical use of the apparatus. The lower unit in this drawing is shown in the "run" position, and the conveyor 30 will remain in this position until the forward roll 36 is near depletion. At this point, a photocell or other suitable actuating means may be employed for initiating movement of the new roll to the position of the second unit in FIG. 10, the "paste" position. The photocell arrangement may, for example, involve a beam directed at the side of the roll, and when the diameter of the roll decreases to a preset value, the beam of the photocell will energize a light sensitive member positioned on the opposite side of the roll. It will be appreciated that the system is capable of manual control, that it, an operator could initiate this phase of the operation.

Photocell means are preferably set to first detect a first diameter of the expiring roll, the roll at this time having a fairly significant amount of web material remaining. This will initiate operation of motor 42 to index the new roll 36 to the paste position. A switch operating cam 37 (FIG. 11) is preferably associated with the conveyor 30 with one limit switch 39 operating when the new roll reaches the paste position to shut off the conveyor 30 and to initiate extension of cylinders 94 so that the belts 48 are moved into engagement with the new roll. The new roll is thus brought up to speed while the expiring roll is being further reduced in diameter. A second, lesser diameter, is then detected by the photocell means for purposes of initiating the paste and severing operation.

With reference to the paste and severing operation, the motor 116 may be operated to pivot the triangular frames 110 when the aforementioned first diameter is detected. The pasting operation is preferably initiated through the combination of a black mark 118 on the side of new roll 36 and photocell 120 mounted on the machine frame. This combination will only be operable after the aforementioned second diameter is detected, and the brush movement may conventionally involve the operation of an air cylinder associated with the frames 110. Additional air cylinders may operate the blade shaft 108 which, in accordance with conventional practice, will usually occur after one additional revolution of the black mark 118.

In a typical situation, the first detection diameter of the expiring roll will be between 6 and 7 inches while the second detection diameter will be 4½ inches, these figures applying to a roll with a 4¼ inch diameter core. The detection of the first diameter of the expiring roll by the photocell may also serve as the means for initiating application of corebrake 140. Specifically, the corebrake will be partially applied at this point while the expiring roll is diminishing in diameter from the first diameter to the second diameter to prevent unravelling. The brake is fully applied in response to detecting of the second diameter to stop the expiring roll when it is severed.

When the pasting and severing cycle has been completed, the triangular carriage moves out of the way and the conveyor indexes forwardly to the position of the top unit of FIG. 10. In this position, a new roll can be loaded onto the conveyor. Thereafter, the conveyor indexes forwardly to the "run" position of the lower unit so that it is ready for the next cycle.

As the new roll is indexed forwardly from the paste position to the run position, the floating frame for belts 48 is lowered to move the forward end of the belts below the plane of conveyors 30 so that the near depleted roll can be discharged. This rolls up the loose portion of the expired roll. It will be appreciated that movement of the large new roll against the belts will tend to lower the floating frame to permit discharge of an expired roll. The frame control cylinders 89 and 94 are also available, for example, when the new roll is of lesser diameter.

The new roll 36 in the top unit of FIG. 10 is of smaller diameter, and it will be appreciated that rolls of various standard sizes may be readily utilized in the construction.

The apparatus of the invention may also include means for controlling the web edge positions. This is particularly accomplished by utilizing an edge guide mechanism as best illustrated in FIG. *7a*. In this arrangement, an upper rail 18' defines a channel 144 which defines the end 34 of shaft 130.

The upper rail 18' has a pair of outwardly extending screws 146 rigidly attached thereto. These screws are spaced apart longitudinally along the side of the apparatus with appropriate passages 148 being defined by the side frame 12 to permit longitudinal movement of the screws relative to the side frame.

Each of the screws extends within an internally threaded bore 150 of a worm gear 152. A longitudinally extending threaded shaft 154 engages both worms and a motor 156 is mounted on the side frame for driving the shaft 154.

Figure 3:
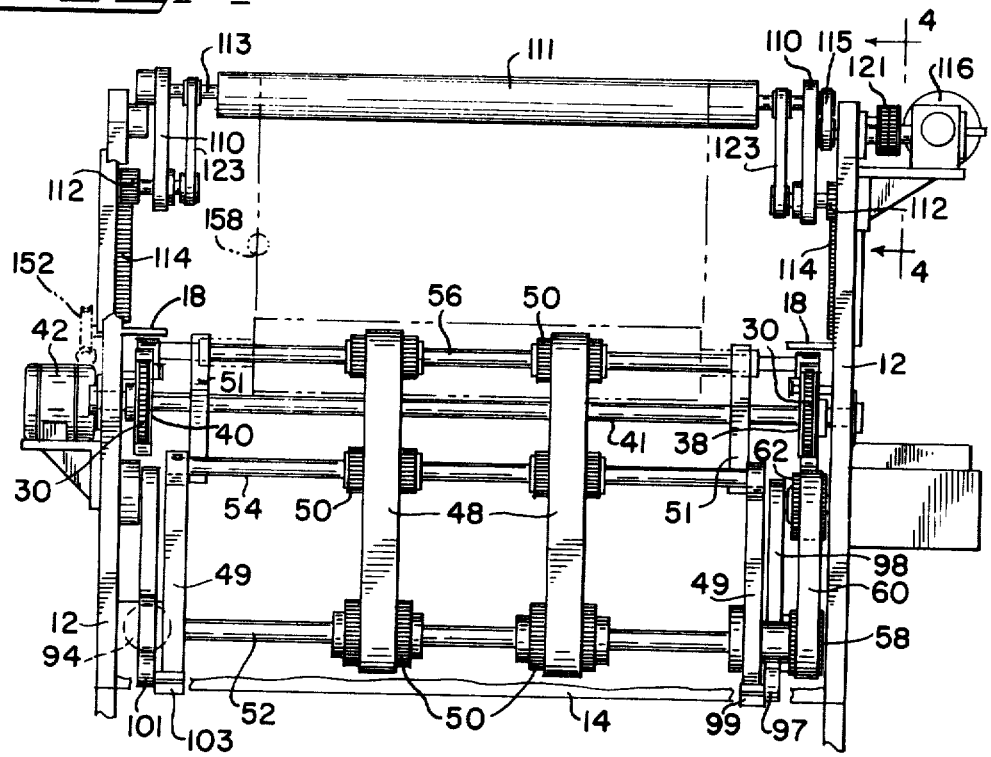
FIG. 3 is a vertical sectional view taken about the line 3—3 of FIG. 1.
Figure 4:
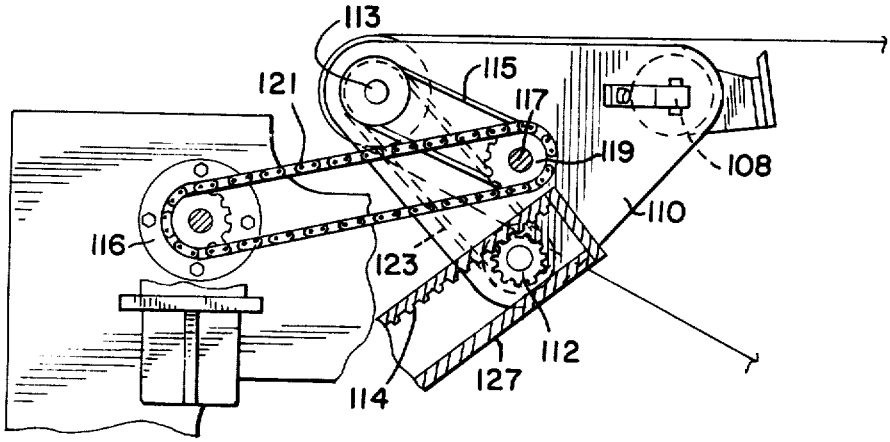
FIG. 4 is an enlarged fragmentary view taken about the line 4—4 of FIG. 3.

In the operation of the arrangement of FIG. *7a*, a photocell or similar control element 158 (as shown in FIG. 3) is utilized for observing the position of a web edge. By connecting the element 158 to the drive for motor 156 through an amplifier and comparator in well-known fashion, the motor 156 will be operated to turn shaft 154 in response to changes in position of the web edge. The comparator will, of course, operate to cause the motor to rotate in one direction or the other depending upon variations from a predetermined null position.

It will be noted that the upper plate 18' extends along the length of the apparatus whereby both the forward roll which is feeding web and the fresh roll newly inserted in the apparatus will be affected by the movement of the upper plate. Accordingly, a soon as the splicing operation occurs and the fresh web is being fed, the fresh roll will immediately be under control to insure that the edge position of the fresh web is correct.

Figure 11:
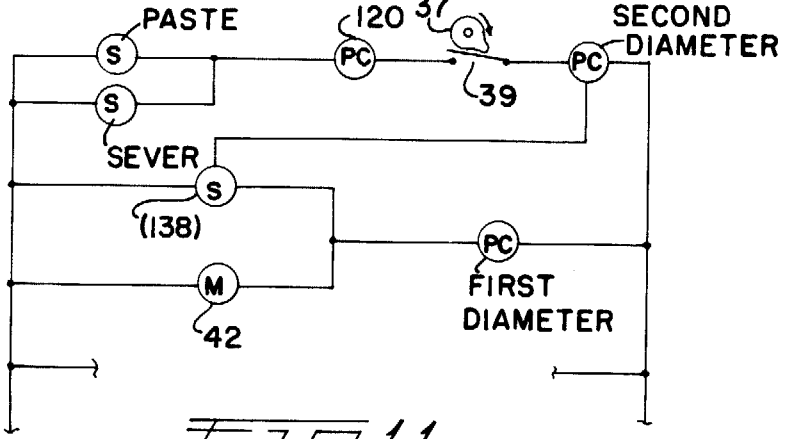
FIG. 11 is a schematic view illustrating a portion of a suitable control system.

The various operations described, particularly the indexing of conveyor 30 by means of motor 42, can be readily achieved by standard control systems. As noted, manual action of controls is also possible. FIG. 11 schematically illustrates a portion of a control system typical of the type contemplated by this invention. This drawing illustrates "paste" and "sever" solenoids which, as discussed, are activated through a photocell means 120 which detects the black mark 118 on a new roll. The cam operated switch 39 must be closed by cam 37 in response to positioning of the new roll by conveyor 30 before the photocell means 120 will operate. Furthermore, the photocell means for detecting the "second diameter" must also be operated.

The solenoid for operating cylinder 138 is, as indicated, also made operative by the "second diameter" photocell so that the expired roll will stop. The "first diameter" photocell means also applies a signal to the corebrake solenoid when the roll is near expiring to prevent unraveling. At the same time, this photocell means starts motor 42 for bringing the new roll to the paste position. Other elements in the control system will provide for other operations in accordance with any of several available alternatives.

It will be understood that various changes and modifications may be made in the above described apparatus without departing from the spirit thereof, particularly as defined in the following claims.

That which is claimed is:

1. In an apparatus for providing a continuous supply of a web wherein the web is fed from a roll supported in a forward position on a roll stand, another roll of web material supported in a rearward position on the roll stand, and means actuatable in response to near depletion of the forward roll for adhesively connecting a leading end portion of the web of the rearward roll with the web of the forward roll and for thereafter severing the engaged portion of the forward roll from the remainder of the forward roll, the improvement comprising one belt means for drivingly engaging both the forward and rearward rolls prior to connecting of the webs of the respective rolls whereby the rolls are driven at substantially the same speed when the connection is made, tension control means for maintaining a predetermined tension in the web, said control means including means for changing the speed of said belt means in response to the detection of variations from said predetermined tension, the change in speed restoring said predetermined tension in said web.

2. An apparatus in accordance with claim 1 wherein said belt means comprise a pair of belts located in side-by-side relationship and engageable with the peripheries of said rolls at points beneath the roll axes.

3. An apparatus in accordance with claim 1 wherein said web material is being fed to a printing press, press drive means, and means for connecting said press drive means to said belt drive means, said means for connecting the respective drive means including said means for changing the speed of said belt means.

4. An apparatus in accordance with claim 3 wherein said means for supporting the respective rolls comprises an endless conveyor, spaced apart roll shaft supports provided on said conveyor, means for driving the conveyor to index the roll shaft supports forward subsequent to the operation of the web connecting and severing means whereby said remainder of the forward roll is moved off the conveyor while said rearward roll is indexed to the forward roll position.

5. An apparatus in accordance with claim 4 wherein a roll shaft support on the conveyor is indexed to a rearward position when a roll is indexed to said forward position whereby a new roll can be loaded onto the conveyor at said rearward position.

6. An apparatus in accordance with claim 5 wherein said conveyor locates a pair of roll shaft supports in respective forward and rearward positions until said forward roll is near depletion, said conveyor drive means including means for thereafter indexing said conveyor forwardly to a first intermediate web connecting and severing position for operation of said web connecting and severing means.

7. An apparatus in accordance with claim 6 wherein said conveyor drive means further includes means for indexing said conveyor forwardly to a second intermediate load position for the loading of a new roll on the conveyor at said rearward position, and said conveyor drive means further including means for thereafter indexing the conveyor forwardly to locate a pair of the roll shaft supports in the respective forward and rearward positions.

8. An apparatus in accordance with claim 4 wherein said conveyor comprises a pair of endless chains located on opposite sides of the apparatus, said roll shaft supports comprising aligned sets carried by the respective chains.

9. An apparatus in accordance with claim 8 including rotatable sleeves supported at each end of each roll shaft, said sleeves being received by said sets when a roll is loaded onto the conveyor.

10. An apparatus in accordance with claim 9 wherein a roll shaft portion between each sleeve and the web material is exposed, friction means located at the end of the conveyor for engaging the exposed shaft portions after severing of the web and during movement of the forward roll off the conveyor whereby the forward roll is rotated during such movement to wrap free web material around this roll as this roll moves off the conveyor.

11. In an apparatus for providing a continuous supply of a web wherein the web is fed from a roll supported in a forward position on a roll stand, another roll of web material supported in a rearward position on the roll stand, and means actuatable in response to near depletion of the forward roll for adhesively connecting a leading end portion of the web of the rearward roll with the web of the forward roll and for thereafter severing the engaged portion of the forward roll from the remainder of the forward roll, the improvement comprising one belt means for drivingly engaging both the forward and rearward rolls prior to connecting of the webs of the respective rolls whereby the rolls are driven at substantially the same speed when the connection is made, a floating frame construction supporting said belt means, and means applying pressure to said frame construction for urging said belt means against said rolls.

12. An apparatus in accordance with claim 11 wherein said belt means comprise a pair of belts located in side-by-side relationship and engageable with the peripheries of said rolls at points beneath the roll axes.

13. An apparatus in accordance with claim 11 wherein said means for supporting the respective rolls comprises an endless conveyor, spaced apart roll shaft supports provided on said conveyor, means for driving the conveyor to index the roll shaft supports forward subsequent to the operation of the web connecting and severing means whereby said remainder of the forward roll is moved off the conveyor while said rearward roll is indexed to the forward roll position, said movement of the forward roll forcing said floating frame downwardly to free said forward roll for movement off the conveyor.

14. An apparatus in accordance with claim 11 wherein said floating frame comprises spaced-apart arms, transversely extending rollers supported by said arms for carrying said belt means, and wherein said means for applying pressure include lever means connected to said arms.

15. An apparatus in accordance with claim 14 including air pressure means engaging said lever means for applying said pressure to said frame constructions.

16. An apparatus in accordance with claim 14 including drive means for said belt means, said drive means being movable with said floating frame.

17. An apparatus in accordance with claim 16 wherein drive means for said belt means comprises an additional drive belt, one end of said additional drive belt being drivingly engaged with one of said rollers carrying said belts, the other end of said additional drive means being supported on a drive shaft, and wherein said drive shaft provides a pivot axis for said lever means.

18. An apparatus in accordance with claim 11 including vertically extending side walls, said means for supporting said rolls being attached to said side walls, the means for connecting and severing the web material and for driving the rolls being supported between said walls, and including at least one additional apparatus defining corresponding side walls, the side walls of said additional apparatus being supported on top of the side walls of the first mentioned apparatus whereby said additional apparatus is adapted to feed a separate web in vertically spaced relationship relative to the web fed from said first mentioned apparatus.

19. An apparatus in accordance with claim 14 including additional means for applying pressure to said frames comprising suspension means connected to said arm forwardly of said lever means, said frame being pivotable about the connection of said lever means with said frame, and said suspension means being adapted to pivot said frame relative to said pivotal connection.

20. In an apparatus for providing a continuous supply of a web wherein the web is fed from a roll supported in a forward position on a roll stand, another roll of web material supported in a rearward position on the roll stand, and means actuatable in response to near depletion of the forward roll for adhesively connecting a leading end portion of the web of the rearward roll with the web of the forward roll and for thereafter severing the engaged portion of the forward roll from the remainder of the forward roll, the improvement wherein said means for supporting the respective rolls comprises an endless conveyor, spaced apart roll shaft supports provided on said conveyor, said means actuatable in response to near depletion of the forward roll comprising detecting means for detecting the diameter of the forward roll, means responsive to operation of said detecting means when a first diameter is detected to operate said endless conveyor for moving the other roll supported in a rearward position to a connecting and severing position, belt means movable into engagement with said other roll for driving the other roll up to the speed of said forward roll, and means operable in response to detecting of a second diameter of said forward roll for initiating said connecting and severing operations.

21. An apparatus in accordance with claim 20 including corebrake means engageable with said forward roll, means for applying said corebrake means to said forward roll in response to detection of said first diameter whereby resistance is applied to said forward roll as the forward roll is diminished from said first diameter to said second diameter.

22. An apparatus in accordance with claim 11 including means for detecting the position of an edge portion of the web of the forward roll, a roll shaft engaging means connected to said detecting means, and drive means for moving said engaging means and for thereby shifting said shaft along its axes, said drive means being connected to said detecting means whereby variations in the position of the web edge will operate said drive means to provide corresponding variations in the roll shaft position.

23. An apparatus in accordance with claim 1 including pairs of upper and lower guide plates confining the respective ends of each of the roll shafts for said forward and rearward rolls, said roll shaft engaging means comprising at least one of said upper guide plates whereby movement of said upper guide plate by said drive means operates to shift the position of both the forward and rearward rolls.

* * * * *